United States Patent [19]

Barrett et al.

[11] 4,340,425

[45] Jul. 20, 1982

[54] NICRAL TERNARY ALLOY HAVING IMPROVED CYCLIC OXIDATION RESISTANCE

[76] Inventors: Robert A. Frosch, Administrator of the National Aeronautics and Space Administration, with respect to an invention of Charles A. Barrett, Seven Hills; Carl E. Lowell, Lakewood, both of Ohio; Abdus S. Khan, Palm Beach Garden, Fla.

[21] Appl. No.: 199,769

[22] Filed: Oct. 23, 1980

[51] Int. Cl.[3] ..... C22C 19/05

[52] U.S. Cl. ..... 148/428; 420/445; 420/551; 420/588

[58] Field of Search ..... 75/170, 171; 148/32, 148/32.5

[56] References Cited

U.S. PATENT DOCUMENTS

Re. 29,920 2/1979 Baldwin ..... 75/171
4,054,469 10/1977 Jackson ..... 75/171

FOREIGN PATENT DOCUMENTS 1001186 8/1965 United Kingdom .

*Primary Examiner*—R. Dean
*Attorney, Agent, or Firm*—Norman T. Musial; John R. Manning; Gene E. Shook

[57] ABSTRACT

NiCrAl alloys are improved by the addition of zirconium. These alloys are in the $\beta$ or $\gamma/\gamma'+\beta$ region of the ternary system.

Zirconium is added in a very low amount between 0.06 and 0.20 weight percent. There is a narrow optimum zirconium level at the low value of 0.13 weight percent.

Maximum resistance to cyclic oxidation is achieved when the zirconium addition is at the optimum value.

3 Claims, No Drawings

NICRAL TERNARY ALLOY HAVING IMPROVED CYCLIC OXIDATION RESISTANCE

ORIGIN OF THE INVENTION

The invention described herein was made in the performance of work under a NASA contract and is subject to the provisions of Section 305 of the National Aeronautics and Space Act of 1958, Public Law 85-568(72) Statute 435; 42 USC 2457).

TECHNICAL FIELD

This invention is concerned with improving NiCrAl alloys. Basic NiCrAl systems have been proposed as coating alloys.

The invention is particularly directed to providing NiCrAl alloys having improved cyclic oxidation resistance in air at 1100° to 1200° C. These improved alloys have superior cyclic oxidation resistance that approaches that of the Fe-base FeCrAl alloys used as furnace heating elements at temperatures to 1300° C.

The rare earth elements, such as yttrium, have been added to NiCrAl alloys. This addition has limited solubility in this alloy system. In addition, the material is not only expensive, but it is also highly reactive and the amount needed for optimum resistance has not been established.

BACKGROUND ART

Jackson U.S. Pat. No. 4,054,469 is directed to a series of directionally solidified eutectic $\gamma+\beta$ nickel base superalloys which contain not only chromium and aluminum, but also iron and/or cobalt. The patent further calls for a number of other elements such as B,W, Mo and Zr. The Zr is apparently a tramp element ranging from 0 to 0.1 weight percent. The patentee is concerned with improving the cyclic oxidation resistance of this nickel base superalloy. However, cyclic oxidation resistance is in no way indicated as being related to any spall inhibitor, such as Zr, and no discussion is set forth on optimizing the composition of the Zr.

Baldwin U.S. Pat. No. Re. 29,920 relates to a nickel base superalloy that is similar to that set forth in Jackson U.S. Pat. No. 4,054,469. However, the aluminum content of the alloy is only up to eight percent. Also, the patent lists many other constituents which are present in the alloy.

British Pat. No. 1,001,186 to Sands et al. is also directed to a nickel base superalloy that is quite similar to that of the two aforementioned patents. The aluminum content can be as high as 10 percent, and the alloy can be employed in powder metallurgy. Here again, this alloy of the British patent contains many other constituents.

DISCLOSURE OF INVENTION

A NiCrAl alloy produced in accordance with the present invention in the $\beta$ or $\gamma/\gamma'+\beta$ region of the ternary system has superior cyclic oxidation resistance in air at 1100° to 1200° C.

According to the invention, the zirconium is added in a very small amount, in the range of 0.06 to 0.20 weight percent. There is a narrow optimum zirconium level at the low value of 0.13 weight percent for maximum cyclic oxidation resistance.

This zirconium addition covers the broad general range of 0–20 a/o Cr and 17.5 to 50 a/o Al which is mainly in the $\beta+\gamma$ and $\beta$ region of a NiCrAl system.

BEST MODE FOR CARRYING OUT THE INVENTION

The NiCrAl alloy of the present invention has the metal zirconium added in a very low amount between 0.06 and 0.20 w/o. This alloy range is critical because the oxide spalling rate is critically high on both sides of these zirconium alloy limits. This range is within the NiCrAl alloy's solid solubility limits of zirconium.

A number of test alloys were prepared in accordance with the invention. The test alloys were in the $\beta+\gamma/\gamma'$ regions of the Ni-Cr-Al phase diagram. The nominal compositions of these alloys are Ni-14-Cr-24Al-xZr. The actual composition of each test alloy is shown in Table I.

TABLE I

CHEMICAL COMPOSITION OF Ni—Cr—Al—xZr TEST ALLOYS

| Alloy No. | Zr, a/o | Cr, a/o | Al, a/o | Melt history | Method of Zr pickup |
|---|---|---|---|---|---|
| 1 | 0.63 | 14.01 | 22.34 | Scratch induction melt, | Held extra long crucible |
| 2 | .33 | 12.30 | 23.17 | Induction remelt, $Al_2O_3$ crucible | Alloy addition to master heat |
| 3 | .275 | 14.68 | 24.00 | Arc melted Cu mold | Alloy addition |
| 4 | .205 | 12.44 | 22.72 | Scratch induction melt, $ZrO_2$ crucible | Std. melt. random pickup |
| 5 | .18 | 16.81 | 29.19 | ↓ | ↓ |
| 6 | .173 | 9.73 | 17.18 | ↓ | ↓ |
| 7 | .110 | 15.98 | 17.54 | ↓ | ↓ |
| 8 | .066 | 14.35 | 23.65 | ↓ | ↓ |
| 9 | .0329 | 19.15 | 24.16 | ↓ | ↓ |
| 10 | .032 | 11.50 | 25.58 | ↓ | ↓ |
| 11 | .0228 | 20.84 | 16.52 | ↓ | ↓ |
| 12 | .0213 | 18.87 | 26.99 | ↓ | ↓ |
| 13 | 0.0 | 13.89 | 25.14 | Master ingot | No Zr in ingot |

As shown in Table I the zirconium content varied from 0 to 0.63 a/o (1.10 w/o Zr). In test alloys 2 and 3 the zirconium was added as an element during induction melting. The zirconium was picked up from the zirconia crucible used in melting test alloys 4 to 12 inclusive.

The Ni-14Cr-24Al-xZr alloys were cyclically oxidized at 1100° C. and 1200° C. Six samples were suspended individually in alumina furnace tubes. The suspended specimens were automatically raised and lowered by pneumatic cylinders controlled by reset timers. As the samples were raised, individually shielded cups were automatically positioned under the samples to catch the oxide spall. Each coupon used for oxidation was 22×10×2 mm with a small hole drilled in one end for wire suspension in the furnace.

Samples were cleaned ultrasonically in alcohol before testing. Each cycle consisted of one hour heating and a minumum of 20 minutes cooling.

The samples were weighed at various test times and specific weight change/time curves were generated. From these data oxidation attack with time was estimated at 1100° and 1200° C. as a function of zirconium content to derive the optimum Zr levels.

The oxide scales were characterized by metallography and were analyzed by electron microprobe. The samples were also examined by X-ray diffraction periodically to identify the oxides formed. The results are shown in Table II.

TABLE II.

TEST ALLOYS AFTER 200 ONE-HOUR CYCLES AT 1100° AND 1200° C.

| | 1100° C. | | 1200° C. | |
|---|---|---|---|---|
| Alloy No. | Surface | Spall | Surface | Spall |
| 1 | $Al_2O_3$<br>8.05 spinel[a]<br>Ni S.S.<br>$ZrO_2$ (mono.)<br>$ZrO_2$ (cubic) | NiO (s)<br>$Al_2O_3$ (s)<br>8.30 spinel (w)[b]<br>8.05 spinel (w)<br>$Cr_2O_3$ (w)<br>Unknown a-1.96<br>2.17 | NiO<br>8.10 spinel<br>8.25 spinel<br>$Al_2O_3$<br>$Cr_2O_3$<br>$ZrO_2$<br>Ni S.S. | NiO (s)<br>$Al_2O_3$ (s)<br>8.10 spinel (m)<br>8.30 spinel (w)<br>$Cr_2O_3$ (vw)<br>$ZrO_2$-mold (vw) |
| 2 | $Al_2O_3$<br>8.05 spinel<br>$ZrO_2$ (mono.)<br>$ZrO_2$ (cubic)<br>Ni S.S. | No significant spall after 200 hours | 8.10 spinel<br>$Al_2O_3$<br>$Cr_2O_3$<br>NiO<br>$ZrO_2$<br>Ni S.S. | 8.05 spinel (s)<br>$Al_2O_3$ (s)<br>NiO (w)<br>$ZrO_2$-cubic (w)<br>$ZrO_2$-mold (w)<br>Unknown spinel (vw) |
| 8 | $Al_2O_3$<br>8.05 spinel<br>Ni S.S.<br>$Ni_3Al$ (?)<br>$ZrO_2$<br>Unknown a-1.96<br>2.17 | No significant spall after 200 hours | $Al_2O_3$<br>8.05 spinel<br>Ni S.S.<br>$Ni_3Al$ possible | No significant spall after 200 hours |
| 13 | $Cr_2O_3$<br>8.10 spinel<br>$Al_2O_3$<br>Ni S.S. | $Al_2O_3$ (s)<br>NiO (m)<br>8.30 spinel (w)<br>8.10 spinel (w)<br>$Cr_2O_3$ (w) | NiO<br>8.10 spinel<br>$Al_2O_3$<br>8.20 spinel<br>$Cr_2O_3$<br>Ni S.S. | NiO (s)<br>$Al_2O_3$ (w)<br>8.10 spinel (w)<br>8.30 spinel (w)<br>$Cr_2O_3$ (w) |

[a]$NiAl_2O_4$ spinel - Ao, 8.05 to 8.20 A
[b]Chromite spinels - Ao, > 8.25 A

The surfaces listed in Table II are in decreasing order of intensity of surface phases. The spalling is characterized by strong (s), medium (m), weak (w), and very weak (vw) powder intensities. The sample of alloy No. 1 cracked and was removed after 190 hours/cycles at 1200° C.

A much smaller amount of zirconium is alloyed with the NCrAl than the amount of yttrium previously used. Also, zirconium is much less expensive. The cast form of the zirconia containing NiCrAl alloy is more machinable than similar NiCrAl alloys containing yttrium. The overall cyclic oxidation resistance of the NiCrAl alloy with a very optimum zirconium level of 0.13 w/o zirconium is superior to NiCrAl alloys containing yttrium or any other additive.

It was not expected that zirconium would be superior to any other additive, particularly yttria. An even more surprising result is the fact that there is a narrow optimum zirconium level at the low value of 0.13 w/o for maximum cyclic oxidation resistance. This effect covers the broad general range of 0–20 a/o chromium and 17.5 to 50 a/o aluminum which is mainly in the $\beta+\gamma$ and $\beta$ region of the NiCrAl system.

While the preferred embodiment of the invention has been described it will be appreciated if various alternatives may be utilized without departing from the spirit of invention and the scope of the subjoined claims.

We claim:

1. A nickel base terniary alloy system in the $\beta+\gamma$ and $\beta$ regions having improved resistance to cyclic oxidation in air at an elevated temperature between about 1100° C. and about 1200° C. consisting essentially of about 10 a/o to about 20 a/o chromium,
about 17.5 a/o to about 50 a/o aluminum,
about 0.13 w/o zirconium, and
the balance nickel.

2. A nickel base alloy system as claimed in claim 1 wherein the alloy contains between about 17.5 to about 30 a/o chromium.

3. An improved cyclic oxidation resistant nickel base terniary alloy of the NiCrAl type consisting essentially of about 14 atomic percent chromium,
about 24 atomic percent aluminum,
about 0.13 weight percent zirconium, and
the balance nickel.

* * * * *